US008521064B2

(12) United States Patent
Yamauchi

(10) Patent No.: US 8,521,064 B2
(45) Date of Patent: Aug. 27, 2013

(54) IMAGE FORMING APPARATUS WITH AN OPENING AND CLOSING UNIT

(75) Inventor: Akihito Yamauchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/314,903

(22) Filed: Dec. 8, 2011

(65) Prior Publication Data

US 2012/0141158 A1 Jun. 7, 2012

Related U.S. Application Data

(62) Division of application No. 11/902,147, filed on Sep. 19, 2007, now Pat. No. 8,095,039.

(30) Foreign Application Priority Data

Mar. 30, 2007 (JP) ..... 2007-092036

(51) Int. Cl.
*G03G 15/08* (2006.01)

(52) U.S. Cl.
USPC ..... 399/121; 399/124

(58) Field of Classification Search
USPC ..... 399/121, 124
See application file for complete search history.

(56) References Cited

U.S. PATENT DOCUMENTS

| | | | |
|---|---|---|---|
| 5,041,872 | A | 8/1991 | Nukaya et al. |
| 5,122,841 | A | 6/1992 | Sasaki |
| 5,300,998 | A | 4/1994 | Ogisawa et al. |
| 5,587,769 | A | 12/1996 | Sawada et al. |
| 5,802,426 | A | 9/1998 | Miyazaki et al. |
| 5,930,564 | A | 7/1999 | Ookaji |
| 6,343,198 | B1 | 1/2002 | Sato |
| 6,785,492 | B2 | 8/2004 | Tanizaki et al. |
| 6,788,910 | B2 | 9/2004 | Kida |

(Continued)

FOREIGN PATENT DOCUMENTS

| | | |
|---|---|---|
| CN | 1532641 A | 9/2004 |
| CN | 1790192 A | 6/2006 |
| JP | A-11-184197 | 7/1999 |
| JP | A-2006-282381 | 10/2006 |

OTHER PUBLICATIONS

Chinese Patent Office, *Notification of the First Office Action for CN 200710151445.X* (with English translation), mailed Mar. 29, 2011, pp. 1-5 (pp. 1-8 for translation).

(Continued)

*Primary Examiner* — David Gray
*Assistant Examiner* — Geoffrey Evans
(74) *Attorney, Agent, or Firm* — Oliff & Berridge, PLC

(57) ABSTRACT

An image forming apparatus includes: a main body; an opening and closing unit disposed so as to be openable and closable for the main body; a fixing unit fixing the opening and closing unit to the main body; a structure including a component for realizing an image forming function and/or a transfer medium-conveying function, the structure supported movably for the main body; a bias unit disposed between the opening and closing unit and the structure, the bias unit biasing the structure so as to be pushed to a member; a constraining unit constraining the opening and closing unit and the structure against a bias force of the biasing unit when the fixing unit does not fix the opening and closing unit; and a releasing unit releasing the opening and closing unit and the structure from being constrained when the fixing unit fixes the opening and closing unit.

5 Claims, 19 Drawing Sheets

(56) References Cited

U.S. PATENT DOCUMENTS

| | | | | |
|---|---|---|---|---|
| 6,968,143 | B2 | 11/2005 | Blair et al. | |
| 6,993,268 | B2 | 1/2006 | Otaka | |
| 6,999,698 | B2 | 2/2006 | Yamauchi et al. | |
| 7,130,560 | B2 | 10/2006 | Kawai et al. | |
| 7,162,182 | B2 | 1/2007 | Tonges et al. | |
| 7,257,351 | B2 | 8/2007 | Tachiki et al. | |
| 7,302,221 | B2 | 11/2007 | Shyu | |
| 7,349,648 | B2 * | 3/2008 | Rennick et al. | 399/110 |
| 7,386,252 | B2 * | 6/2008 | Portig et al. | 399/110 |
| 7,471,917 | B2 | 12/2008 | Hiroe et al. | |
| 7,551,876 | B2 | 6/2009 | Kurita | |
| 7,628,483 | B2 | 12/2009 | Nakagawa | |
| 7,664,427 | B2 | 2/2010 | Kawasumi et al. | |
| 7,676,176 | B2 | 3/2010 | Fujiwara et al. | |
| 7,783,230 | B2 | 8/2010 | Ju et al. | |
| 7,809,308 | B2 | 10/2010 | Sekiya | |
| 7,917,062 | B2 | 3/2011 | Shin et al. | |
| 8,041,253 | B2 * | 10/2011 | Carter et al. | 399/110 |
| 8,095,039 | B2 * | 1/2012 | Yamauchi | 399/121 |
| 8,315,539 | B2 * | 11/2012 | Uehara | 399/124 |
| 8,401,426 | B2 * | 3/2013 | Nieda | 399/114 |
| 2002/0061212 | A1 | 5/2002 | Tanaka | |
| 2004/0175210 | A1 | 9/2004 | Otaka | |
| 2004/0237690 | A1 | 12/2004 | Masuda et al. | |
| 2005/0036804 | A1 | 2/2005 | Yokoi | |
| 2005/0084306 | A1 | 4/2005 | Nakaoka et al. | |
| 2006/0018672 | A1 | 1/2006 | Asaba | |
| 2006/0039718 | A1 | 2/2006 | Yokoi | |
| 2006/0093397 | A1 | 5/2006 | Yamaoka | |
| 2006/0099008 | A1 * | 5/2006 | Kurita | 399/110 |
| 2006/0104662 | A1 | 5/2006 | Kawasumi | |
| 2006/0120756 | A1 | 6/2006 | Ahn et al. | |
| 2007/0036585 | A1 | 2/2007 | Ochi | |
| 2007/0154238 | A1 | 7/2007 | Yokoi | |
| 2007/0189804 | A1 | 8/2007 | Yasumitsu | |
| 2007/0212108 | A1 | 9/2007 | Hozono et al. | |
| 2010/0278557 | A1 | 11/2010 | Somemiya et al. | |
| 2010/0329738 | A1 | 12/2010 | Shirai | |
| 2011/0193925 | A1 | 8/2011 | Matsushima et al. | |
| 2013/0077995 | A1 * | 3/2013 | Tokunaga et al. | 399/124 |

OTHER PUBLICATIONS

Dec. 16, 2011 Japanese Office Action issued in Japanese Patent Application No. 2007-092036 (with translation).

* cited by examiner

IMAGE FORMING APPARATUS WITH AN OPENING AND CLOSING UNIT

This is a Divisional of U.S. patent application Ser. No. 11/902,147 filed Sep. 19, 2007. The disclosure of the prior application is incorporated herein by reference in its entirety.

CROSS-REFERENCE TO RELATED APPLICATION

This application is based on and claims priority under 35 USC §119 from Japanese Patent Application No. 2007-92036 filed Mar. 30, 2007.

BACKGROUND

Technical Field

The present invention relates to an image forming apparatus.

SUMMARY

According to an aspect of the invention, there is provided an image forming apparatus comprising:

a main body;

an opening and closing unit disposed so as to be openable and closable with respect to the main body;

a fixing unit that fixes the opening and closing unit to the main body;

a structure comprising a component for realizing at least one of an image forming function and a transfer medium-conveying function, the structure being supported movably with respect to the main body;

a bias unit disposed between the opening and closing unit and the structure, the bias unit biasing the structure so as to push the structure to at least one member mounted within the main body;

a constraining unit that cons trains the opening and closing unit and the structure against a bias force of the biasing unit when the fixing unit does not fix the opening and closing unit; and a releasing unit that releases the opening and closing unit and the structure from being constrained when the fixing unit fixes the opening and closing unit.

BRIEF DESCRIPTION OF THE DRAWINGS

Embodiments of the present invention will be described in detail based on the following figures, wherein.

DETAILED DESCRIPTION

Next, exemplary embodiments according to the invention will be described with reference to the drawings.

Figure 1:
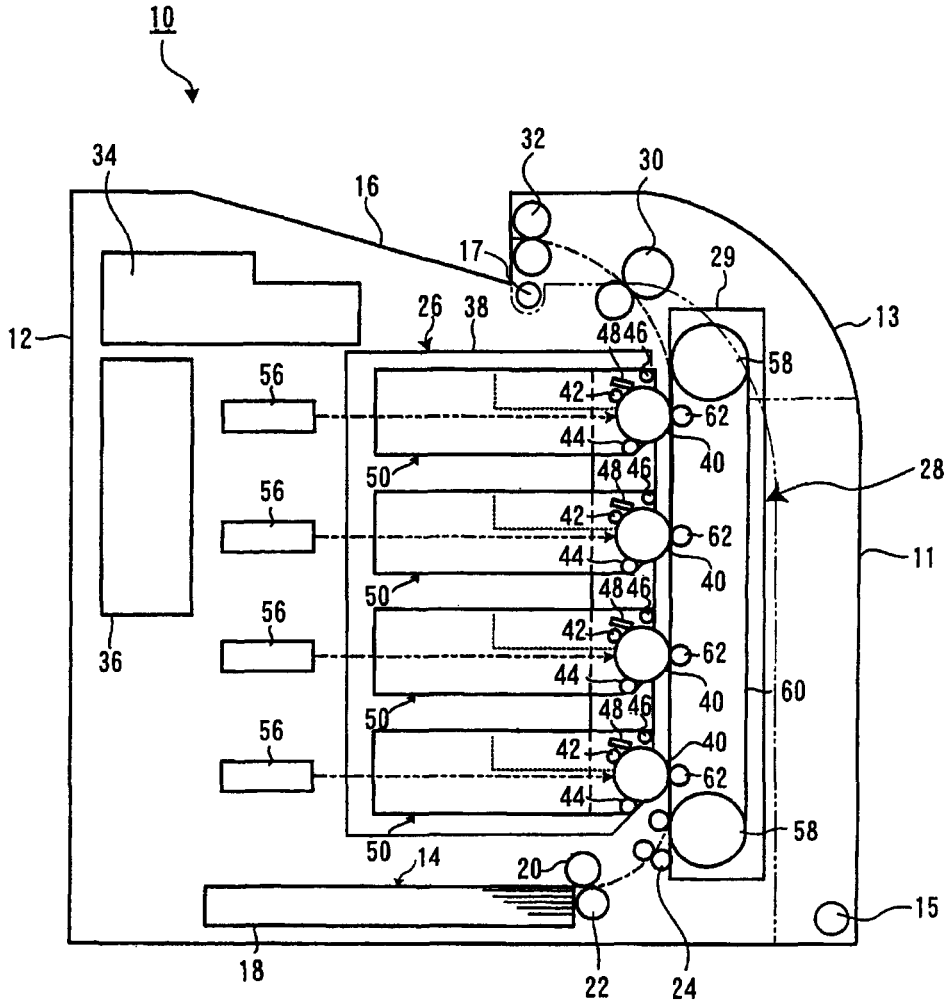
FIG. 1 is a side view showing a schematic structure of an image forming apparatus according to a first exemplary embodiment of the invention.

FIG. 1 shows an image forming apparatus 10 according to a first exemplary embodiment of the invention. This image forming apparatus 10 has a main body 12 of the image forming apparatus, a paper feeding apparatus 14 disposed on the lower part of the main body 12, and a paper discharge unit 16 formed on the upper part of the main body 12.

The paper feeding apparatus 14 has a sheet tray 18 and sheets to be used as a transfer medium are stacked on the sheet tray. A feed roll 20 is disposed on an upper part of one end of the sheet tray 18, and a retard roll 22 is disposed being opposed to the feed roll 20. The sheet positioned at the highest position of the sheet tray 18 is picked up by the feed roll 20 and then, the sheet is brushed and conveyed in combination with the feed roll 20 and the retard roll 22.

The sheet conveyed from the sheet tray 18 is temporarily stopped by a resist roll 24, and at a timing, the sheet goes through between a photoconductor unit 26 and a transfer unit 28 and through a fixing apparatus 30, and is discharged to the paper discharge unit 16 to be described later by a paper discharge roll 32.

On the front side of the image forming apparatus main body 12 (namely, the right side in FIG. 1), a front cover 11 as a first opening and closing unit is disposed. The front cover 11 is mounted rotatably (movably) by an axis 15 as a support unit with respect to the image forming apparatus main body 12 and the front cover 11 is rotated around the axis 15 so as to be opened to the front side of the image forming apparatus main body 12. In addition, on the upper side of the image forming apparatus main body 12, an upper cover 13 as a second opening and closing unit is disposed. The upper cover 13 is rotated by an axis 17 as a support unit with respect to for the image forming apparatus main body 12 so as to be opened to the upper side of the image forming apparatus main body 12.

The upper cover 13 is closed so as to overlap the front cover 11 in a closed state, from the front side. In other words, the upper cover 13 as being closed may interfere with the front cover 11 being opening or closing. Therefore, unless the upper cover 13 is opened, the front cover 11 cannot be opened. In addition, after closing the front cover 11, the upper cover 13 is closed.

In the interior part of the image forming apparatus main body 12, the photoconductor unit 26, the transfer unit 28, a power source unit 34, and a control unit 36 are disposed. The photoconductor unit 26 is used as a mounted member detachably mounted in the interior part of the image forming apparatus main body 12 and includes a photoconductor unit main body 38. For example, four sub units 50 are supported by the photoconductor unit main body 38. Each of sub units 50 has a photoconductor 40. A charging apparatus 42 used as a charging unit provided with a charging roll for uniformly charging the photoconductor 40, a developing apparatus 44 used as a developing unit for developing a latent image formed on the photoconductor 40 with a development agent image (a toner), a charge removal apparatus 46 used as a charge removing unit for removing electricity from the photoconductor 40 by irradiating a light to the transcribed photoconductor 40, and a cleaning apparatus 48 as a development agent removing unit for removing the development agent remaining in the photoconductor 40 after transfer is made are provided around the photoconductor 40.

Four sub units 50 may include one for forming a yellow toner image, one for forming a magenta toner image, one for forming a cyan toner image, and one for forming a black toner image, from an upstream in a sheet conveying direction, which is the lower side in the gravity direction, and a yellow toner image, a magenta toner image, a cyan toner image, and a black toner image are formed on the surfaces of respective photoconductors 40. Each of four sub units 50 can be attached and detached in the interior part of the photoconductor unit main body 38.

Each of optical writing apparatuses 56 includes a laser exposure apparatus and they are arranged on the positions corresponding to respective photoconductors 40 on the rear face side of the photoconductor unit 26 so as to form a latent image by irradiating a laser to the uniformly charged photoconductor 40.

The transfer unit 28 is used as a structure and is arranged in a longitudinal direction being opposed to the photoconductor unit 26 on the front side of the photoconductor unit 26. The transfer unit 28 has a transfer unit main body 29. In the interior part of the transfer unit main body 29, two support rolls 58 are mounted in a vertical direction and a conveying belt 60 is hanged on the two support rolls 58. In addition, in the interior part of the transfer unit main body 29, a transfer roll 62 is mounted so as to be opposed to each photoconductor 40 across the conveying belt 60.

The conveying belt 60 is a member for conveying the sheet and serves to realize a conveying function of the sheet (the transfer medium). In addition, the transfer roll 62 is a member used for transfer, which is a part of an image forming function. In this way, the transfer unit 28 has at least one member for realizing at least one of the image forming function and the transfer medium conveying function.

In the image forming apparatus 10 that is constructed as described above, the photoconductor 40 is uniformly charged by the charging apparatus 42, a latent image is formed by the optical writing apparatuses 56, and the latent image is developed by the developing apparatus 44 so as to form a development agent image (a toner image). The development agent images formed on the photoconductor 40 are transferred on the sheet conveyed by the conveying belt 60 in the order from the lower one by using the transfer roll 62 of the transfer unit 28 to be fixed on the sheet by the fixing apparatus 30.

Figure 2:
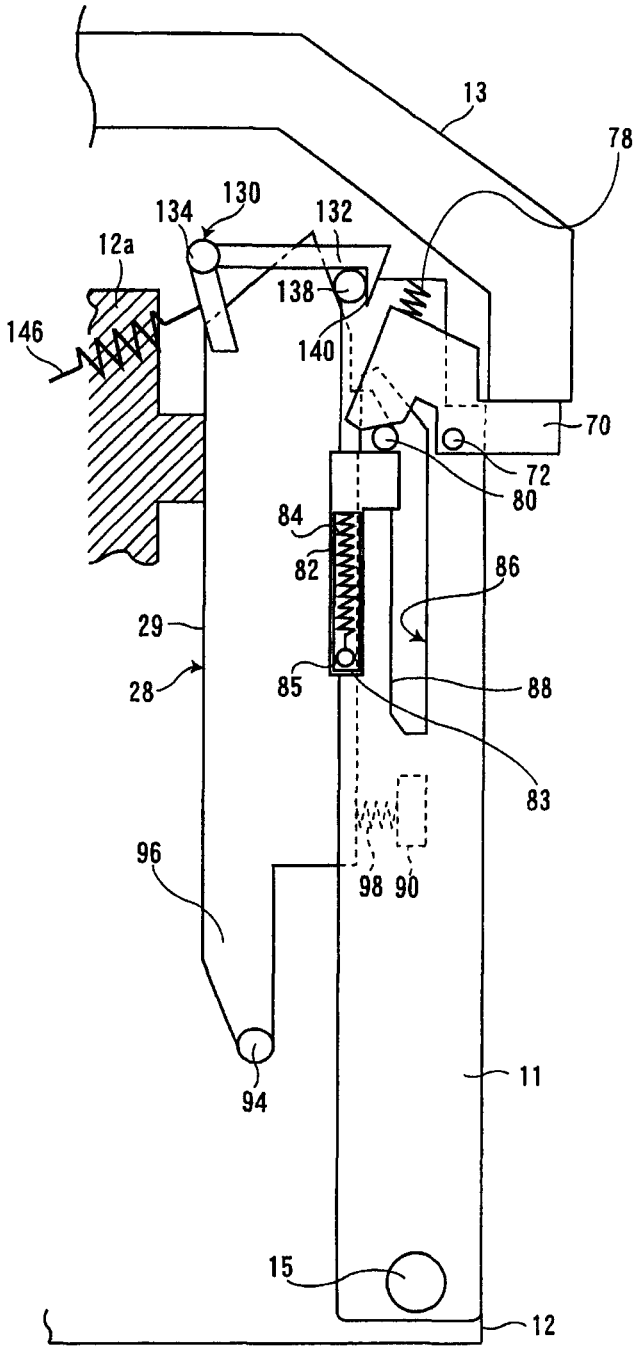
FIG. 2 is a side view showing a state in which a front cover and a transfer unit used for the first embodiment are assembled in a main body of the image forming apparatus.
Figure 3:
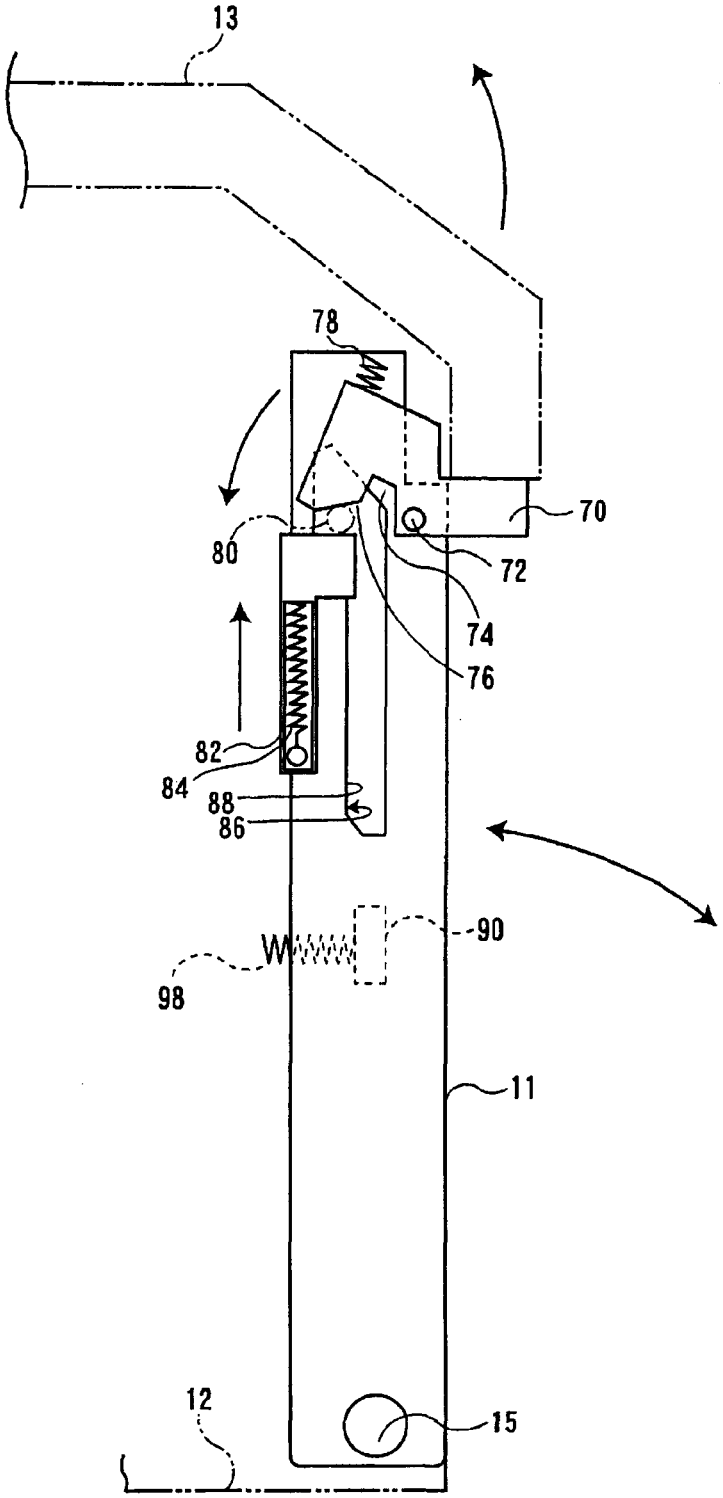
FIG. 3 is a side view showing a structure of the front cover used for the first embodiment.
Figure 4:
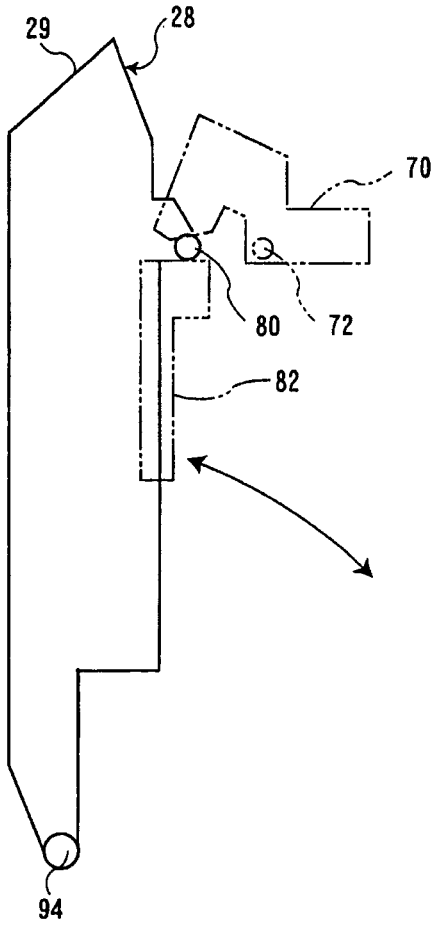
FIG. 4 is a side view showing a structure of the transfer unit used for the first embodiment.

FIG. 2 shows the front cover 11 and the transfer unit 28, FIG. 3 shows the front cover 11, and FIG. 4 shows the transfer unit 28.

As shown in FIGS. 2 and 4, the transfer unit 28 is disposed on the side of the image forming apparatus main body 12 and by using an axis 94 used as a support unit, the transfer unit 28 is mounted so as to be capable of rotating with respect to the image forming apparatus main body 12 as shown by an arrow direction in the drawing.

In addition, as shown in FIGS. 2 and 3, as described above, the front cover 11 is mounted on the image forming apparatus main body 12 by using the axis 15, and as shown by an arrow in the drawing, the front cover 11 is rotatably opened and closed with respect to the image forming apparatus main body 12. In FIGS. 2 and 3, the front cover 11 as being closed for the image forming apparatus main body 12 is illustrated.

The image forming apparatus 10 according to the first embodiment has a fixing mechanism 130 used as a fixing unit, which is used for fixing the front cover 11 at a closed position. The fixing mechanism 130 has a fixing member 132 and the fixing member 132 is rotatably mounted in the image forming apparatus main body 12 around an axis 134. In addition, the fixing member 132 has an operation unit (not illustrated) that is used for the operation by an operator and a contact unit 140 contacting a protrusion 138 for fixing, which is used for fixing the front cover 11.

In addition, the fixing mechanism 130 has a bias member 146, for example, made of a coil spring, and the bias member 146 biases the fixing member 132 so as to be rotated around the axis 134 in a clockwise direction around the axis 134. Although the fixing mechanism 130 is disposed on the both sides, the right and left sides of the front cover 11 one by one, namely, two in total, FIG. 2 shows the fixing mechanism 130 located on the left side.

A constraining member 70 is mounted on the both sides, namely, the right and left sides of the front cover 11. The constraining member 70 is used for constraining the front cover 11 and the transfer unit 28 and configures a constraining unit. The constraining member 70 is mounted on the front cover 11 by using the axis 72 to be supported around the axis 72 so as to be capable of rotating for the front cover 11.

In the constraining member 70, a groove 74 is formed, into which a protrusion 80 of a transfer unit main body, formed on the transfer unit main body 29 as a protrusion portion, can be inserted, and a pressing face 76 for pressing the transfer unit main body's protrusion 80 is formed. In addition, in a constraining member 70, for example, a bias member 78 made of an elastic body such as a coil spring is mounted, and the bias member 70 is biased in a direction rotating in an anticlockwise direction around the axis 72 by the bias member 78.

On the both sides, namely, the right and left sides of the front cover 11, a sliding member 82 is mounted so as to be capable of sliding with respect to the front cover 11. A guide hole 83 is formed on the sliding member 82 and a protrusion 85 for mounting, formed on the side of the front cover 11, is inserted into the guide hole 83. On the protrusion 85 for mounting, for example, one end portion of a bias member 84 made of an elastic body such as a coil spring is mounted, and being pressed by other end portion of the bias member 84, the sliding member 82 is biased in an inverse direction to the protrusion 85 for mounting (the upper direction in FIG. 2).

In addition, on the both sides, namely, the right and left sides of the front cover 11, a notch 86 is formed so as to be capable of inserting the transfer unit main body's protrusion 80 disposed on the transfer unit main body 29. On the lower side of the notch 86 in FIG. 2, a guide face 88 for guiding a movement of the transfer unit main body's protrusion 80 is formed. In addition, one end portion of the bias member 98, for example, made of an elastic member such as a coil spring is fixed to the side face in the inside of the front cover 11 via a fixing portion 90.

The bias member 98 has other end portion contacting the transfer unit main body 29. Therefore, the bias member 98 may press the transfer unit 28 to a main body frame 12*a* forming a part of the image forming apparatus main body 12 so as to be rotated around the axis 94 in an anticlockwise direction. Therefore, being biased by the bias member 98, the transfer unit 28 is positioned and fixed to a usage position shown in FIG. 2 where the transfer unit 28 is used for forming an image.

Due to the bias member 98, an appropriate figuration other than a configuration that the transfer unit 28 is positioned being pressed to the main body frame 12*a* can be selected, for example, a configuration that the transfer unit 28 is pressed to the photoconductor 40 of the photoconductor unit 26 and a configuration that the transfer unit 28 is positioned being pressed to the both of the main body frame 12*a* and the photoconductor unit 26 or the like. In other words, the bias member 98 may bias the transfer unit 28 so as to be pressed to at least any of the image forming apparatus main body 12 and a mounted member such as the photoconductor 40 and the photoconductor unit 26, mounted in the interior part of the image forming apparatus main body 12.

In this way, the bias member 98 is disposed between the front cover 11 and the transfer unit 28 and is used as a bias unit for biasing the transfer unit 28 to the image forming apparatus main body 12 or the like. Further, in FIG. 2, the constraining member 70, the bias member 78, the sliding member 82, the bias member 84, and the notch 86 or the like disposed only on the left side are illustrated, however, as described above, they are disposed on the both sides, namely, the right and left sides one by one.

Figure 5:
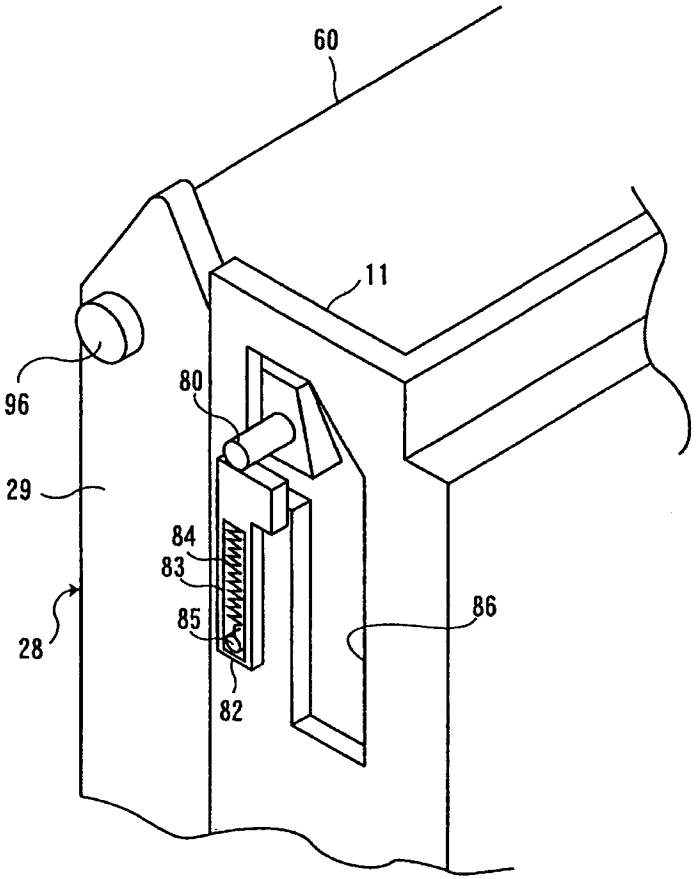
FIG. 5 is a perspective view showing a state in which the front cover and the transfer unit used for the first embodiment are assembled in the main body of the image forming apparatus.

FIG. 5 shows a state in which the front cover 11 and the transfer unit 28 are assembled in the image forming apparatus main body 12. Further, in FIG. 5, the illustration of the constraining member 70 is omitted.

As shown in FIG. 5 and the above-described FIG. 2, the transfer unit main body 29 is assembled in the front cover 11 so that the transfer unit main body's protrusion 80 as a protrusion portion of the transfer unit main body 29 is inserted from the inside into the notch 86 shaped in a reversed L as the notch portion of the front cover 11. The transfer unit main body's protrusion 80 contacts the sliding members 82 disposed on the both sides of the front cover 11 via the front cover 11 provided with the notch 86. In addition, the upper part of the constraining member 70 contacts the upper cover 13 in the closed state as shown in FIG. 2. Then, the contact unit 140 of the fixing member 132 of the fixing mechanism 130 may contact the protrusion for contact 138, and the front cover 11 is fixed to the image forming apparatus main body 12. The notches 86 are disposed on the both sides of the front cover 11 in a condition of a reversed L (namely, shaped in a reversed L) as described above, and the transfer unit main body's protrusion 80 disposed in the transfer unit 28 is located at the positions shown in FIG. 2 and FIG. 5 so as to be released from constraint of the constraining member 70, namely, is located at a constraining released position.

Figure 6:
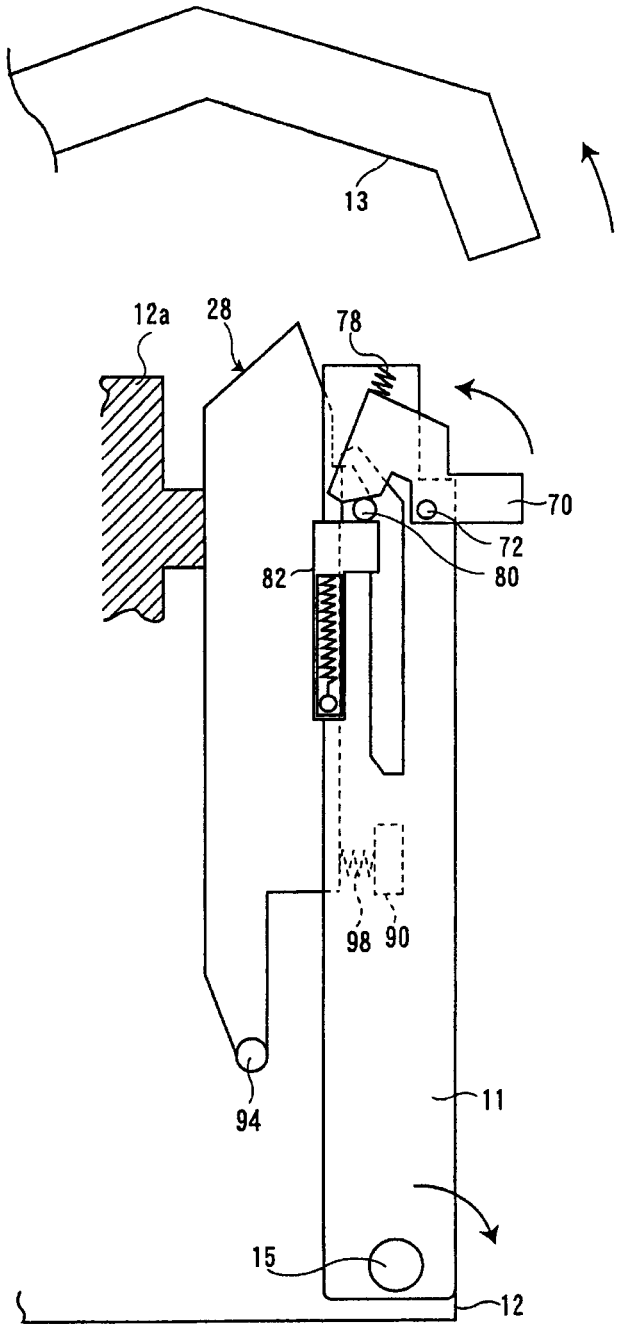
FIG. 6 is a first explanatory view for explaining an operation of the image forming apparatus according to the first embodiment.
Figure 7:
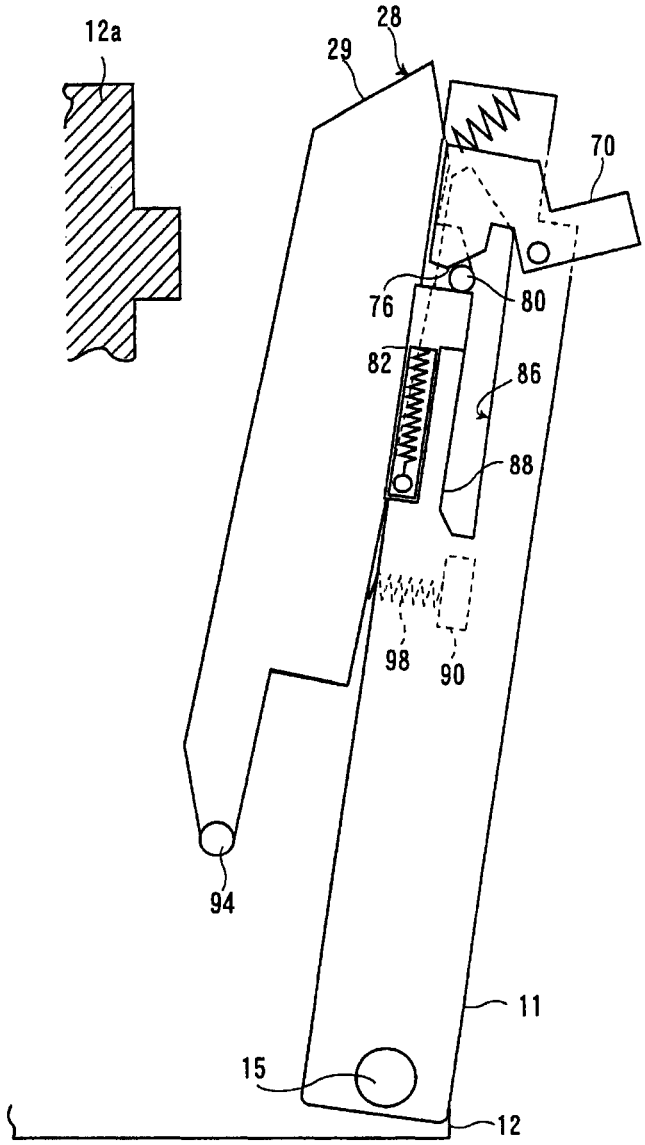
FIG. 7 is a second explanatory view for explaining an operation of the image forming apparatus according to the first embodiment.
Figure 8:
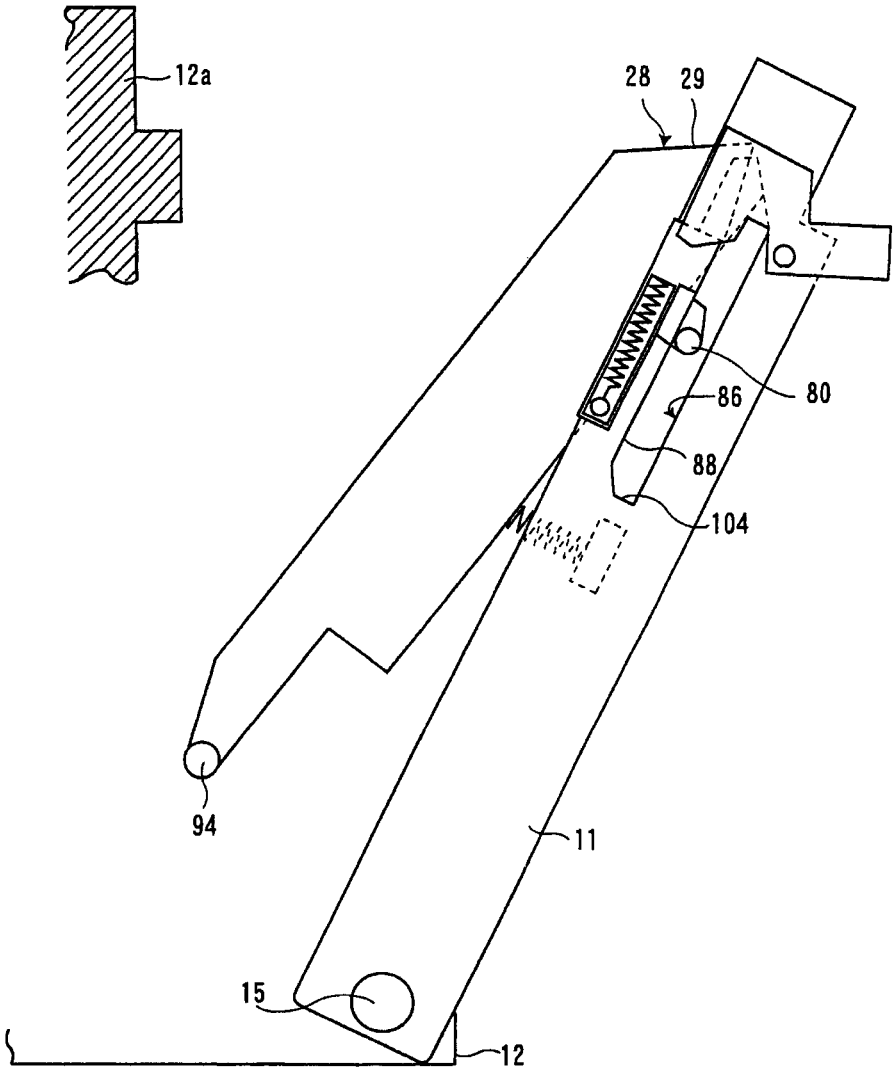
FIG. 8 is a third explanatory view for explaining an operation of the image forming apparatus according to the first embodiment.

With reference to FIGS. 6 to 9, the opening and closing operation of the front cover 11 and the upper cover 13 and the moving operation of the transfer unit 28 will be described below. In FIGS. 6 to 9, the illustration of the fixing mechanism 130 is omitted. In order to open the front cover 11 and the upper cover 13 from a state in which they are closed, as shown in FIG. 6, the operation to open the upper cover 13 is carried out by the operator. By opening the upper cover 13, the front cover 11 can be opened moving from the position interfering with a locus of opening and closing of the front cover 11. Then, when the operator operates an operation unit (not illustrated) of the front cover 11, the fixing mechanism 130 is released, and the operation for opening the front cover 11 is carried out. In this time, the transfer unit main body's protrusion 80 is located at a constraint release position. Then, if the front cover 11 is rotated in a clockwise direction around the axis 15, the transfer unit main body's protrusion 80 disposed on the transfer unit main body 29 may press down the sliding member 82 that is biased upward (FIG. 7), and when the front cover 11 is further rotated, the transfer unit main body's protrusion 80 may move to the position of the guide face 88 in the notch 86 over the sliding member 82 (FIG. 8).

Describing this further in detail, FIG. 8 shows the front cover 11 and the transfer unit 28 when the front cover 11 is opening. Here, since the front cover 11 and the transfer unit main body 29 are supported by the support portions (the axis 15, the axis 94), which are disposed on different positions (the position displaced horizontally or vertically from the main body of the image forming apparatus) of the image forming apparatus main body 12, a relative position with respect to the front cover of the transfer unit main body's protrusion 80 may move in a vertical direction of the image forming apparatus main body 12 in accordance with opening and closing of the front cover 11. Therefore, in combination with opening of the front cover 11, the transfer unit main body's protrusion 80 may press down the sliding member 82 to overleap the sliding member 82 at an opening and closing position.

Then, when the transfer unit main body's protrusion 80 moves to the guide face 88, the transfer unit main body's protrusion 80 is guided into the guide face 88 and this allows the front cover 11 to open. In accordance with this, the transfer unit 28 may move so as to be rotated in the clockwise direction around the axis 94. Then, the front cover 11 and the transfer unit 28 are continuously rotated in the clockwise direction up to the position where the transfer unit main body's protrusion 80 contacts a lower end portion 104 of the notch 86, and then, the front cover 11 and the transfer unit 28 are in the state to be opened with respect to the image forming apparatus main body 12.

Figure 9:
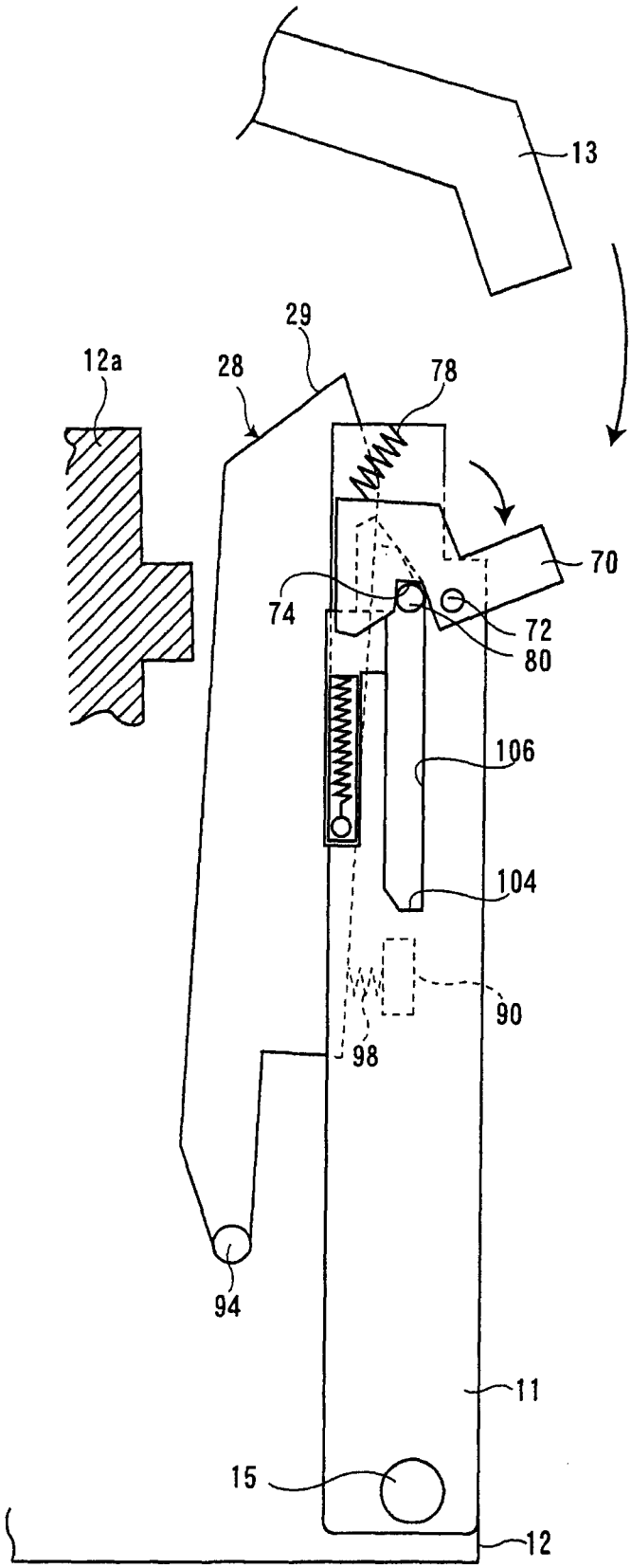
FIG. 9 is a fourth explanatory view for explaining an operation of the image forming apparatus according to the first embodiment.

FIG. 9 shows a state in progress since the front cover 11 and the transfer unit 28 are opened with respect to the image forming apparatus main body 12 (not illustrated) till the front cover 11 shown in the above-described FIG. 4 is closed to be arranged on the position where the transfer unit 28 is used for forming an image. In order to shift a state in which the front cover 11 and the transfer unit 28 are opened with respect the image forming apparatus main body 12 into a state in which the front cover 11 is closed to be arranged on the position where the transfer unit 28 is used for forming an image, the operation by the operator for closing the front cover 11, namely, the operation for rotating the front cover 11 in an anticlockwise direction around the axis 15 will be carried out.

When the front cover 11 moves so as to be rotated around the axis 15 in the anticlockwise direction due to the operation by the operator, the transfer unit main body's protrusion 80 may move so as to be separated from the lower end portion 104 within the notch 86 as being guided by the guide face 88 of the notch 86. Then, in combination with closing of the front cover 11, the transfer unit 28 may move in the anticlockwise direction around the axis 94. When the transfer unit 28 moves in the anticlockwise direction, as shown in FIG. 9, the transfer unit main body's protrusion 80 is in a state to be fitted in the groove 74 of the constraining member 70. In other words, the transfer unit main body's protrusion 80 is in a state in which the front cover 11 is constrained with the transfer unit 28 each other, namely, a constrained state.

In this case, before the transfer unit main body's protrusion 80 is fitted in the groove 74, the transfer unit main body's protrusion 80 may press the face of the sliding member 82 continued to the guide face 88 in a substantially vertical direction. However, since the sliding member 82 is disposed so as to move only in a direction in parallel with the guide face 88, it is not feared that the transfer unit main body's protrusion 80 is deviated from the guiding direction of the guide face 88 before the transfer unit main body's protrusion 80 is fitted in the groove 74, and the transfer unit main body's protrusion 80 fails to be fitted in the groove 74. In this way, the constraining member 70 and the transfer unit main body's protrusion 80 are used as a constraining unit for constraining the front cover 11 and the transfer unit 28. Here, in order to prevent the constraining member 70 from being released upon receipt of a movement in the clockwise direction due to the force that the transfer unit main body's protrusion 80 receives from the bias member 98, it is desirable that the rotational axis 72 is arranged so that the direction of the force that the constraining member 70 receives from the transfer unit main body's protrusion 80 due to the bias member 98 and a virtual line connecting the transfer unit main body's protrusion 80 and the rotational axis 72 substantially coincide with each other.

With the front cover 11 and the transfer unit 28 shown in FIG. 9 constrained, the left end portion of the bias member 98 contacts the transfer unit main body 29. Therefore, the front cover 11 and the transfer unit 28 are in a state in which one member presses the other member with each other. In addition, in the state shown in FIG. 9, the transfer unit main body 29 is separated from the main body frame 12*a* without contacting the main body frame 12*a*. In this way, since the front cover 11 and the transfer unit 28 are constrained and the transfer unit main body 29 is separated from the main body frame 12*a*, when closing the front cover 11, the front cover 11 never receive a force in a direction opened to the image forming apparatus main body 12 due to the bias member 98. In addition, even in the case that the transfer unit main body 29 contacts the main body frame 12*a*, a reaction force that the front cover 11 receives is decreased because the front cover 11 and the transfer unit 28 are constrained.

The operator carries out the operation that the operator opens the upper cover 13 from the state shown in FIG. 9 in which the front cover 11 is closed. During closing of the upper cover 13, the upper cover 13 may contact the constraining member 70 so as to press the constraining member 70 and rotate the constraining member 70 against a bias force of the bias member 78 in the clockwise direction around the axis 72. Then, when the constraining member 70 is rotated in the clockwise direction, the transfer unit main body's protrusion 80 fitted in the groove 74 is detached from the groove 74. Then, since the transfer unit main body's protrusion 80 is detached from the groove 74, constraint between the front cover 11 and the transfer unit 28 is released. Since constraint between the front cover 11 and the transfer unit 28 is released, the transfer unit 28 is biased in a direction so that the transfer unit 28 is rotated around the axis 94 in the anticlockwise direction by means of the bias member 98 and the transfer unit main body 29 is pressed by the main body frame 12*a*. Then, as shown in the above-described FIG. 4, the transfer unit 28 is positioned and fixed to a usage position where the transfer unit 28 is used for forming an image or the like.

Figure 10:
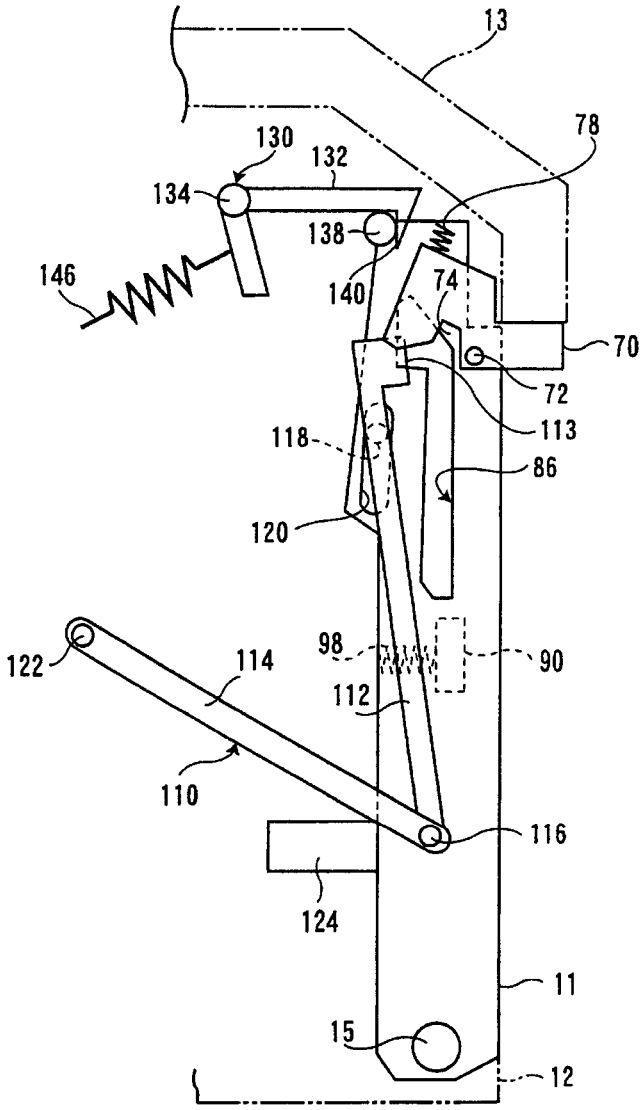
FIG. 10 is a side view showing a structure of the front cover used for a second exemplary embodiment of the present invention.

FIG. 10 shows the front cover 11 that is used for a second exemplary embodiment of the invention.

Although the front cover 11 used for the above-described first embodiment is provided with the sliding member 82, in this second embodiment, the front cover 11 is not provided with the sliding member 82. In addition, according to this embodiment, a connection mechanism 110 used as a connecting unit for connecting the image forming apparatus main body 12 to the front cover 11 is mounted on the front cover 11.

The connection mechanism 110 has a first connection member 112 and a second connection member 114. The first connection member 112 and the second connection member 114 are connected so that they can rotate with each other by using an axis 116. On other end side of the axis 116 of the first connection member 112, a protrusion 118 is formed toward the side of the front cover 11, and the protrusion 118 is guided to a guide groove 120 formed on the front cover 11. In addition, on the other end side of the axis 116 of the first connection member 112, a press face 113 is formed. The second connection member 114 is mounted rotatably in the image forming apparatus main body 12 by using an axis 122.

Figure 11:
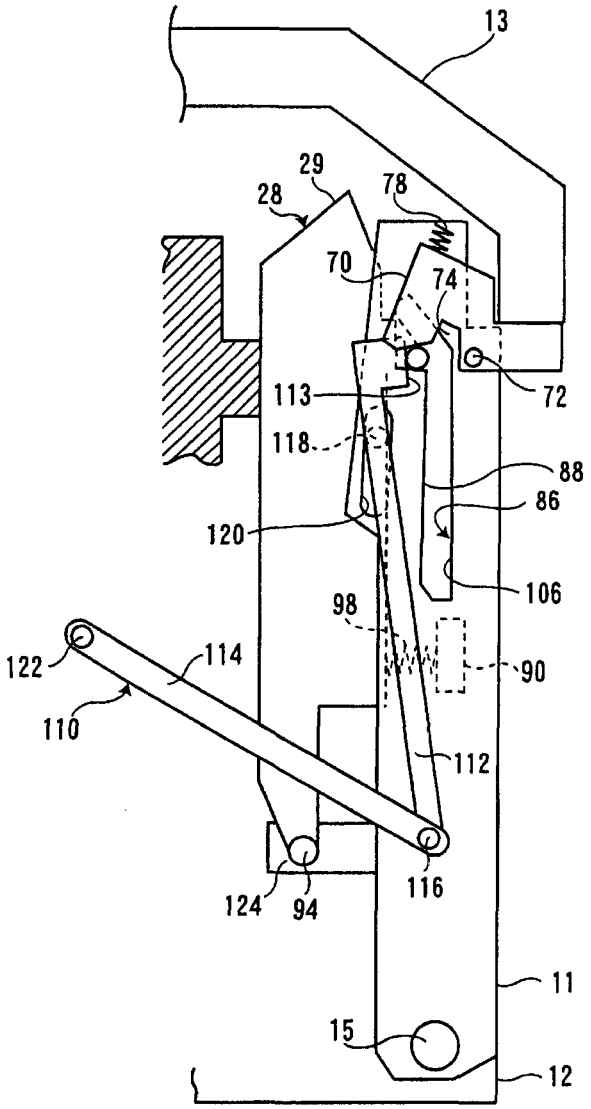
FIG. 11 is a side view showing a state in which a front cover and a transfer unit used for the second embodiment are assembled in a main body of the image forming apparatus.

In addition, according to this second embodiment, a support unit 124 is disposed on the front cover 11 so as to be protruded toward the inside of the image forming apparatus main body 12. Although the connection mechanism 110 and the support unit 124 are disposed on the both side, the right and left sides of the front cover 11 one by one, namely, two in total, FIG. 10 only shows the connection mechanism 110 and the support unit 124, which are located on the left side. In addition, the image forming apparatus 10 according to this second embodiment has the fixing mechanism 130 used as a fixing unit, which is used for fixing the front cover 11 at a position where the front cover 11 is closed, as in the first embodiment FIG. 11 shows a state in which the front cover 11 and the transfer unit 28 are assembled in the image forming apparatus main body 12. FIG. 11 shows such a state that the transfer unit 28 is arranged at a usage position where it is used for forming an image or the like, and the front cover 11 and the upper cover 13 are closed to the image forming apparatus main body 12. According to the above-described first embodiment, the transfer unit 28 is attached so as to be capable of rotating for the image forming apparatus main body 12 by using the axis 94. On the contrary, according to this second embodiment, the transfer unit 28 is disposed to the support unit 124 of the front cover 11 so as to be capable of rotating by using the axis 94. Further, the same parts as the first embodiment are given the same reference numerals and the detailed explanation is herein omitted.

Figure 12:
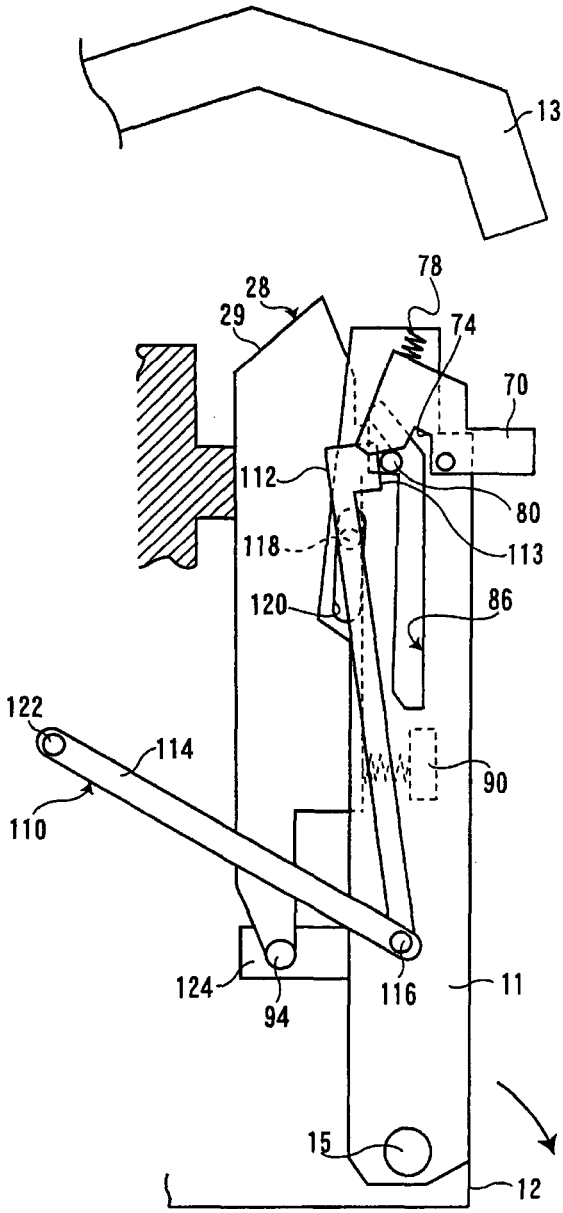
FIG. 12 is a first explanatory view for explaining an operation of the image forming apparatus according to the second embodiment.

With reference to FIGS. 12 to 15, the opening and closing operations of the front cover 11 and the upper cover 13 and the moving operation of the transfer unit 28 according to the second embodiment will be described. Further, in FIGS. 12 to 15, the illustration of the fixing mechanism 130 is omitted. In order to open the front cover 11 and the upper cover 13 from a state in which they are closed, the operation to open the upper cover 13 is carried out by the operator as shown in FIG. 12, as in the above-described first embodiment. By opening the upper cover 13, the upper cover 13 is separated from the constraining member 70 and the front cover 11 can be opened moving from the position interfering with a locus of opening and closing of the front cover 11. Then, when the operator operates an operation unit (not illustrated) of the front cover 11, the fixing mechanism 132 is released, and as shown by an arrow in FIG. 12, the front cover 11 will start to rotate around the axis 15 in the clockwise direction.

When the front cover 11 starts to rotate, in combination with this, the protrusion 118 is guided to the guide groove 120 and the first connection member 112 starts to rotate around the axis 116 in the clockwise direction. Then, since the first connection member 112 starts to rotate, the transfer unit main body's protrusion 80 29 is pressed in a right direction by the press face 113. Then, since the transfer unit main body's protrusion 80 29 is pressed in the right direction, the transfer unit 28 starts to move so as to rotate around the axis 94 in the clockwise direction in combination with the front cover 11.

Figure 13:
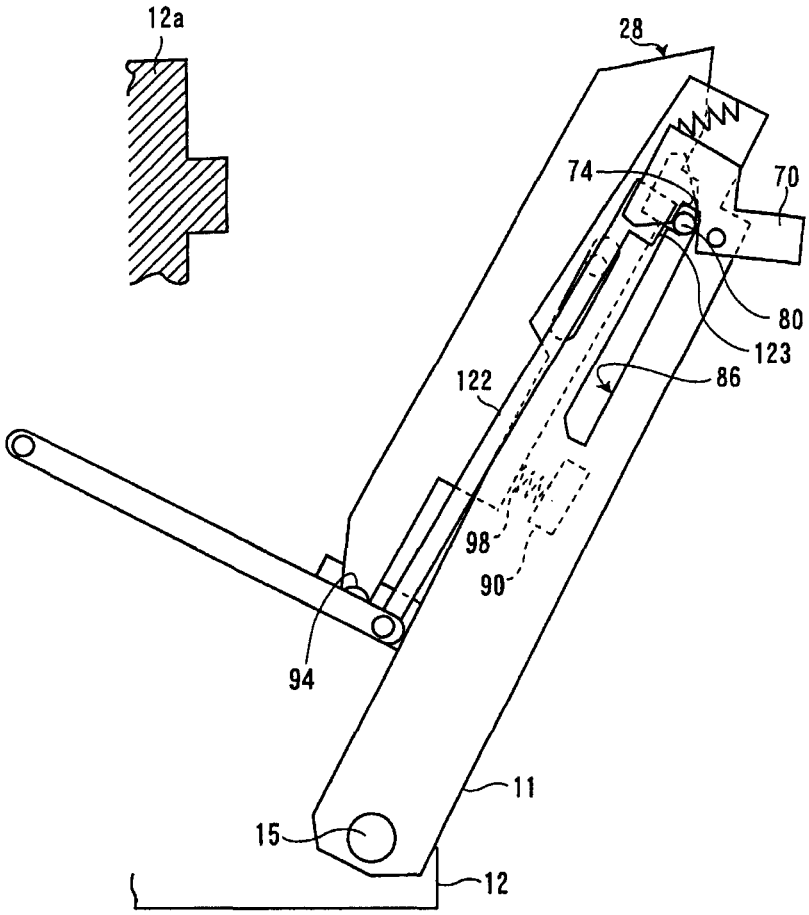
FIG. 13 is a second explanatory view for explaining an operation of the image forming apparatus according to the second embodiment.

FIG. 13 shows the front cover 11 that moves from the state shown in FIG. 12 so as to be rotated around the axis 15 in the clockwise direction being biased by the bias member 98 and the transfer unit 28 that rotationally moves around the axis 94 in the clockwise direction in combination with movement of the front cover 11. In this state, being pressed to the press face 113 of the first connection member 112, the transfer unit main body's protrusion 80 moves to the right side within the notch 86. Then, the transfer unit main body's protrusion 80 moves to be fitted in the groove 74 of the constraining member 70 so as to be in the state such that the front cover 11 and the transfer unit 28 are constrained each other. In other words, in combination with opening of the front cover 11, the front cover 11 and the transfer unit 28 are constrained each other.

Figure 14:
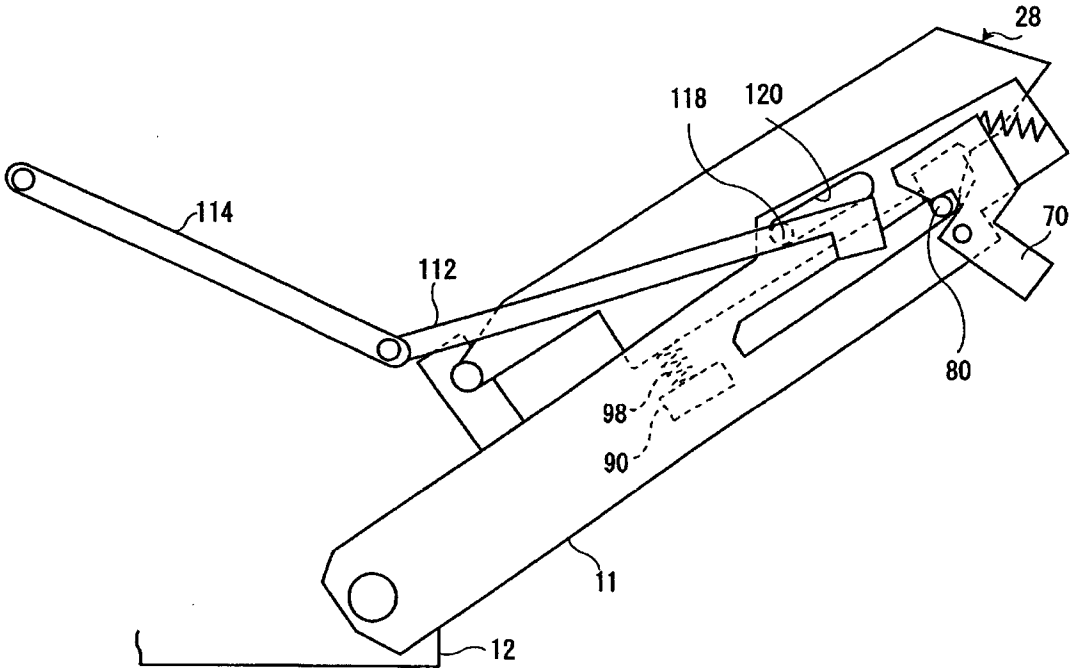
FIG. 14 is a third explanatory view for explaining an operation of the image forming apparatus according to the second embodiment.

FIG. 14 shows the state that the front cover 11 is further opened from the state shown in FIG. 13, for example, when the operator carries out the operation for opening the front cover 11 and the front cover 11 moves due to an effect by gravity. In this state, the front cover 11 may rest for the image forming apparatus main body 12 so that the protrusion 118 contacts the lower end portion of the guide groove 120 and the front cover 11 is opened to the maximum for the image forming apparatus main body 12.

Figure 15:
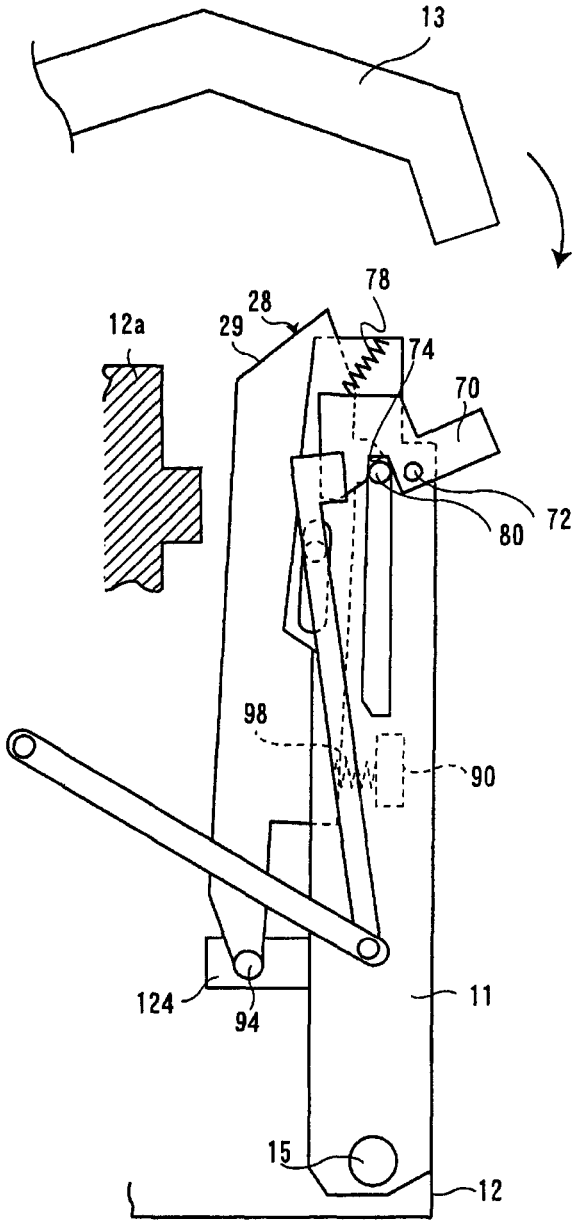
FIG. 15 is a fourth explanatory view for explaining an operation of the image forming apparatus according to the second embodiment.

FIG. 15 shows the state in progress since the front cover 11 and the transfer unit 28 are opened for the image forming apparatus main body 12 (refer to FIG. 14) till the front cover 11 shown in the above-described FIG. 11 is closed to be arranged on the position where the transfer unit 28 is used for forming an image. In order to shift a state in which the front cover 11 and the transfer unit 28 are opened with respect to the image forming apparatus main body 12 into a state in which the front cover 11 is closed to be arranged on the position where the transfer unit 28 is used for forming an image, the operation by the operator for closing the front cover 11, namely, the operation for rotating the front cover 11 in an anticlockwise direction around the axis 15 will be carried out.

In the state shown in FIG. 15, the front cover 11 and the transfer unit 28 are constrained each other and the left end portion of the bias member 98 contacts the transfer unit main body 29. Therefore, the front cover 11 and the transfer unit 28 are in the state that one presses other each other. In addition, in the state shown in FIG. 15, the transfer unit main body 29 is separated from the main body frame 12*a*. In this way, since the front cover 11 and the transfer unit 28 are constrained and the transfer unit main body 29 is separated from the main body frame 12*a*, when the transfer unit 28 is arranged on a usage position where the transfer unit 28 is used for forming an image or the like, the front cover 11 does not receive a force in a direction of being opened to the image forming apparatus main body 12 from the bias member 98 in the case of closing the front cover 11, as in the first embodiment.

The operator carries out the operation to close the upper cover 13 from the state in which the front cover 11 is closed shown in FIG. 15. In the progress of closing the upper cover 13, the upper cover 13 contacts the constraining member 70 so as to press the cons training member 70 and rotate the constraining member 70 around an axis 72 in the clockwise direction against a bias force of a bias member 78. Then, when the constraining member 70 is rotated in the anticlockwise direction, the transfer unit main body's protrusion 80 fitted in the groove 74 is detached from the groove 74. Then, since the transfer unit main body's protrusion 80 fitted in the groove 74 is detached from the groove 74, constraint between the front cover 11 and the transfer unit 28 is released, the transfer unit 28 is biased in a direction so that the transfer unit 28 is rotated around the axis 94 in the anticlockwise direction, and the transfer unit main body 29 is pressed by the main body frame 12*a*. Then, as shown in the above-described FIG. 11, the transfer unit 28 is positioned and fixed to the usage position where the transfer unit 28 is used for forming an image or the like.

Figure 16:
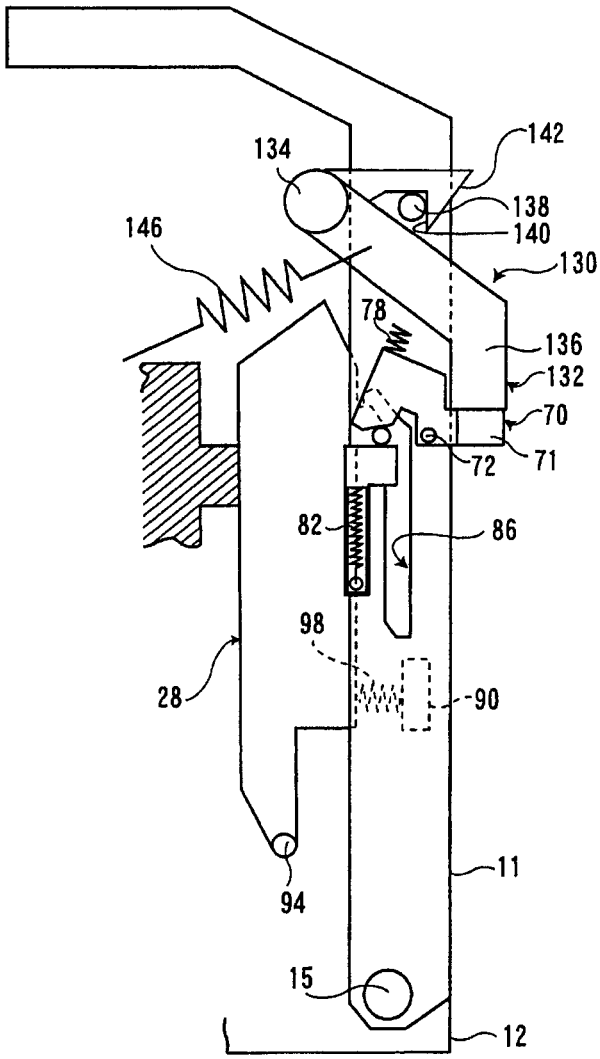
FIG. 16 is a side view showing a structure of the front cover and the transfer unit used for a third exemplary embodiment.

FIG. 16 shows the front cover 11 and the transfer unit 28 that are used for a third exemplary embodiment according to the invention. According to the above-described first and second embodiments, the image forming apparatus 10 has the front cover 11 and the upper cover 13. On the contrary, in this third embodiment, the upper cover 13 is not disposed but the front cover 11 is only disposed. In addition, the image forming apparatus 10 according to this third embodiment has a fixing mechanism 130 as a fixing unit, which is used for fixing the front cover 11, as in the first and second embodiments and In addition, according to this third embodiment, the transfer unit 28 is mounted so as to be capable of being rotated for the image forming apparatus main body 12 by using the axis 94, as in the above-described first embodiment. In addition, according to this third embodiment, a protrusion portion 71 is disposed so as to be protruded in a direction of a paper face, and in the state shown in FIG. 16, the downward face of an operation unit 136 contacts the protrusion portion 71. In order to open the front cover 11 from the closed state, the operator may carry out the operation of the fixing member 132. In other words, the operator may pull the operation unit 136 of the fixing member 132 upward. When the operation unit 136 is pulled upward, the fixing member 132 is rotated around the axis 134 in the anticlockwise direction against the bias force of a bias member 146. Then, since the fixing member 132 is rotated, the contact unit 140 is separated from the protrusion for fixing 138 to be in a state so that the front cover 11 can be opened. The front cover 11 and the transfer unit 28 are continuously rotated in the clockwise direction up to the position where the transfer unit main body's protrusion 80 is in the state of contacting the lower end portion 104 of the notch 86, and the front cover 11 and the transfer unit 28 are in the state of being opened to the image forming apparatus main body 12. Further, the same parts as the first embodiment are given the same reference numerals and the explanation thereof is herein omitted.

Figure 17:
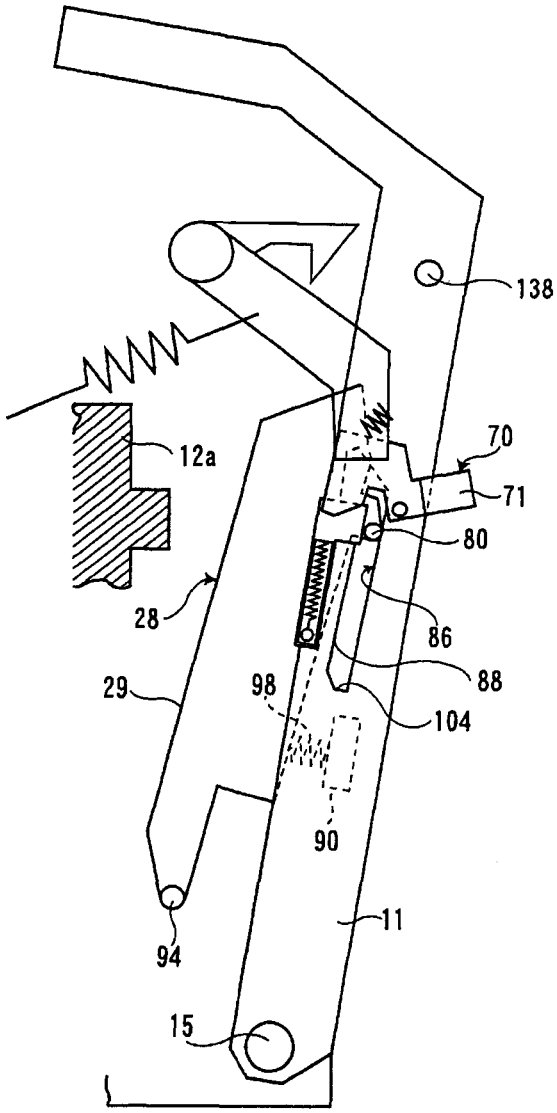
FIG. 17 is a first explanatory view for explaining an operation of the image forming apparatus according to the third embodiment.
Figure 18:
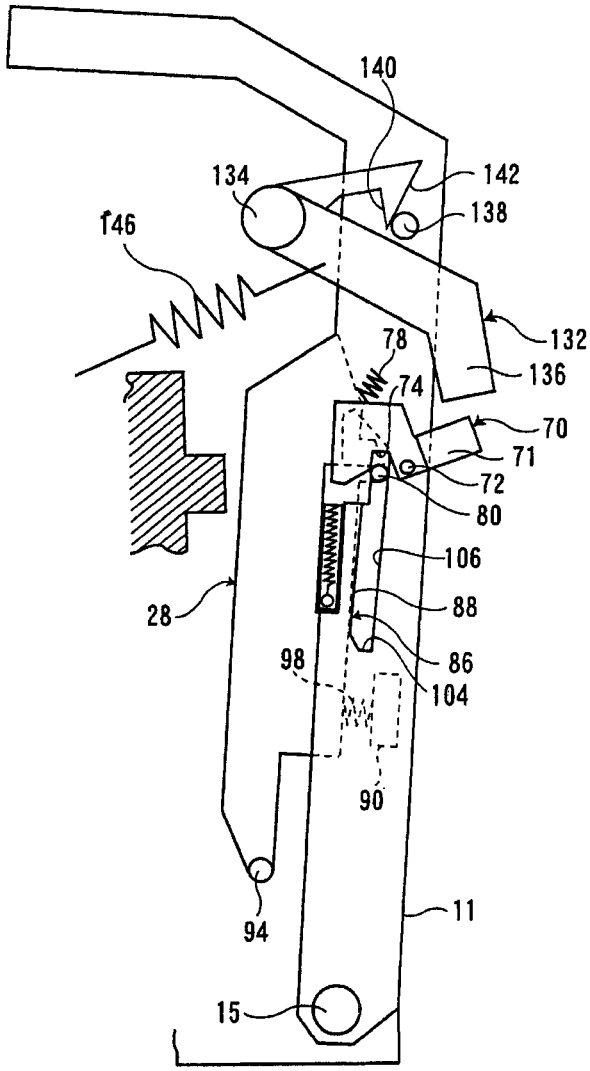
FIG. 18 is a second explanatory view for explaining an operation of the image forming apparatus according to the third embodiment.
Figure 19:
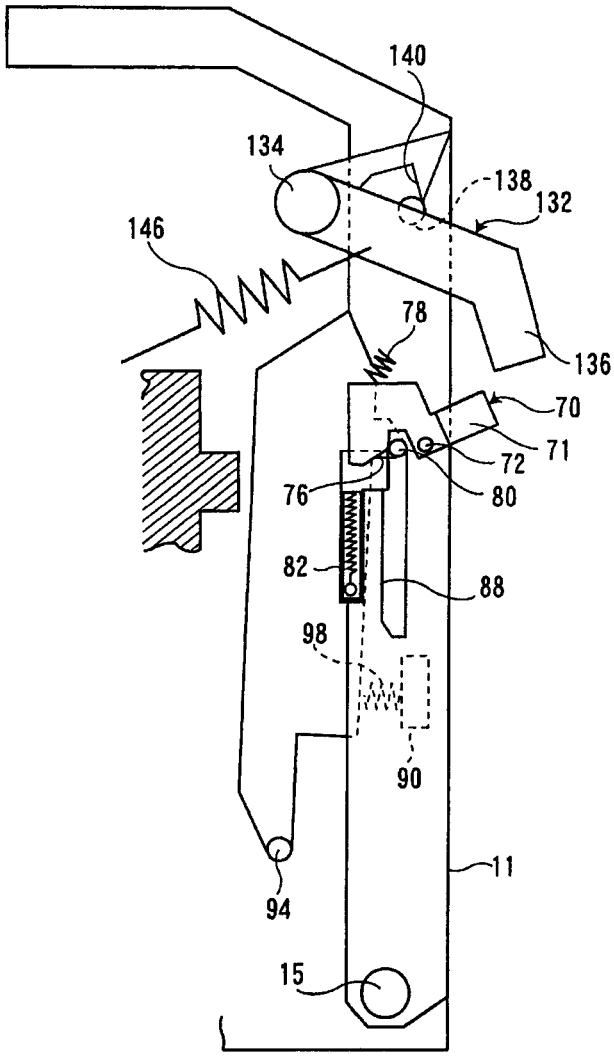
FIG. 19 is a third explanatory view for explaining an operation of the image forming apparatus according to the third embodiment.

FIGS. 17 to 19 illustrate the operation till the front cover 11 is closed and the moving operation of the transfer unit 28. FIG. 17 shows the state in progress since the front cover 11 is opened for the image forming apparatus main body 12 till the front cover 11 shown in the above-described FIG. 16 is closed to be arranged on the position where the transfer unit 28 is used for forming an image. In order to shift a state in which the front cover 11 and the transfer unit 28 are opened for the image forming apparatus main body 12 into a state in which the front cover 11 is closed to be arranged on the position where the transfer unit 28 is used for forming an image, the operation by the operator for closing the front cover 11, namely, the operation for rotating the front cover 11 in the anticlockwise direction around the axis 15 will be carried out.

In the operation by the operator, if the front cover 11 is moved so as to be rotated around the axis 15 in the anticlockwise direction, the transfer unit main body's protrusion 80 is guided into the guide face 88 and this allows the transfer unit main body's protrusion 80 to move within the notch 86 so as to be separated from the lower end portion 104. Then, in combination with closing of the front cover 11, the transfer unit 28 is moved in the anticlockwise direction in the anticlockwise direction around the axis 94. In addition, when the transfer unit main body's protrusion 80 is moved from the state shown in FIG. 18, the transfer unit main body's protrusion 80 is fitted in the groove 74 of the constraining member 70. Then, when the transfer unit main body's protrusion 80 is fitted in the groove 74 of the constraining member 70, the front cover 11 and the transfer unit 28 are constrained each other. In this way, the constraining member 70 and the transfer unit main body's protrusion 80 are used as a constraining mechanism for constraining the front cover 11 and the transfer unit 28 in combination with the operation for closing the front cover 11.

With the transfer unit main body's protrusion 80 fitted in the groove 74 and the front cover 11 and the transfer unit 28 constrained, the left end portion of the bias member 98 contacts the transfer unit main body 29. Therefore, the front cover 11 and the transfer unit 28 are in a state in which one member presses the other member with each other. In addition, in this state, the transfer unit main body 29 is separated from the main body frame 12*a* without contacting the main body frame 12*a*. In this way, since the front cover 11 and the transfer unit 28 are constrained and the transfer unit main body 29 is separated from the main body frame 12*a*, when the transfer unit 28 is arranged on the usage position where the transfer unit 28 is used for forming an image or the like, also in this third embodiment, upon closing of the front cover 11, the front cover 11 does not receive a force in a direction of being opened to the image forming apparatus main body 12 from the bias member 98. Further, although it is preferable that the front cover 11 does not receive the bias force from the bias member 98 in the case of closing the front cover in any embodiment, there is no problem if the bias force is given to an extent such that the operability of the opening and closing unit is not damaged.

From the state shown in FIG. 18, the operator will carry out the operation of the front cover 11. In other words, the front cover 11 is moved so as to be rotated in the anticlockwise direction around the axis 15. Then, due to the above-described operation, the protrusion for fixing 138 formed in the front cover 11 is moved from the side of a press face 142 to the side of the contact unit 140. When the protrusion for fixing 138 is detached from the press face 142, the fixing member 132 is biased by the bias member 146 to be rotated around the axes 134 in the clockwise direction.

Then, as shown in FIG. 19, by rotating the fixing member 132, the protrusion for fixing 138 is fitted in the contact unit 140, the fixing member 132 contacts the constraining member 70, and then, pressing the constraining member 70, the constraining member 70 is rotated in the anticlockwise direction around the axis 72 against the bias force of the bias member 78. Then, if the constraining member 70 is rotated in the anticlockwise direction, the transfer unit main body's protrusion 80 fitted in the groove 74 is detached from the groove 74. Then, since the transfer unit main body's protrusion 80 is detached from the groove 74, constraint between the front cover 11 and the transfer unit 28 is released. Since constraint between the front cover 11 and the transfer unit 28 is released, the transfer unit 28 is biased in a direction so that the transfer unit 28 is rotated around the axis 94 in the anticlockwise direction by means of the bias member 98 and the transfer unit main body 29 is pressed by the main body frame 12*a*. Then, as shown in the above-described FIG. 16, the transfer unit 28 is positioned and fixed to the usage position where the transfer unit 28 is used for forming an image or the like.

As described above, the invention can be applied to an image forming apparatus such as a copying machine, a facsimile, and a printer having an opening and closing unit and a structure, for example, a transfer unit.

What is claimed is:

1. An image forming apparatus comprising:

a main body;

a first opening and closing unit disposed so as to be openable and closable with respect to the main body;

a fixing unit that fixes the first opening and closing unit to the main body;

a second opening and closing unit disposed so as to be openable and closable with respect to the main body, the second opening and closing unit as being closed interfering with the first opening and closing unit opening or closing;

a structure comprising a component for realizing at least one of an image forming function and a transfer medium-conveying function, the structure being supported movably with respect to the main body;

a bias unit disposed between the first opening and closing unit and the structure, the bias unit biasing the structure so as to push the structure to at least one member mounted within the main body;

a constraining unit that constrains the first opening and closing unit and the structure against a bias force of the biasing unit when the first fixing unit does not fix the first opening and closing unit; and a releasing unit that releases the first opening and closing unit and the structure from being constrained when the fixing unit fixes the first opening and closing unit.

2. The image forming apparatus according to claim 1, wherein the releasing unit releases the first opening and closing unit and the structure from being constrained in combination with a closing movement of the second opening and closing unit.

3. The image forming apparatus according to claim 1, wherein the constraining unit constrains the first opening and closing unit and the structure in combination with an opening movement of the first opening and closing unit.

4. The image forming apparatus according to claim 1, wherein the first opening and closing unit and the structure are supported by respective support portions different from each other.

5. The image forming apparatus according to claim 1, further comprising:

a support unit that supports one end of the first opening and closing unit; and a protrusion portion of the structure at the other end of the first opening and closing unit, wherein the first opening and closing unit has a notch portion for guiding the protrusion portion, the notch portion having a constraining position for constraining the first opening and closing unit and the structure, the notch portion having a releasing position for releasing the first opening and closing unit and the structure from being constrained.

* * * * *